US005119715A

United States Patent [19]

Porter, Jr. et al.

[11] Patent Number: 5,119,715

[45] Date of Patent: Jun. 9, 1992

[54] TIME DELAY FUZE

[75] Inventors: Frank K. Porter, Jr., Billerica, Mass.; William Ferriero, Nashua, N.H.; Leo R. Robitaillie, Dracut; Harold B. Mueller, Concord, both of Mass.

[73] Assignee: Raytheon Company, Lexington, Mass.

[21] Appl. No.: 724,631

[22] Filed: Jul. 2, 1991

[51] Int. Cl.[5] ..... F42C 17/04

[52] U.S. Cl. ..... 89/6.5; 102/264; 102/276

[58] Field of Search ..... 89/6, 6.5; 102/264, 102/265, 266, 270, 276, 262, 208

[56] References Cited

U.S. PATENT DOCUMENTS

| | | | |
|---|---|---|---|
| H 466 | 5/1988 | Reiter | 102/200 |
| 3,977,329 | 8/1976 | Wilde | 102/200 |
| 4,072,108 | 2/1978 | Lewis et al. | 89/6 |
| 4,147,109 | 4/1979 | Ziemba | 102/215 |
| 4,389,940 | 6/1983 | Trembly et al. | 102/489 |
| 4,750,424 | 6/1988 | Erlense | 102/200 |
| 4,779,533 | 11/1988 | Winterhaller et al. | 102/270 |
| 5,014,591 | 5/1991 | Porter, Jr. | 89/6 |

FOREIGN PATENT DOCUMENTS

| | | | |
|---|---|---|---|
| 312406 | 11/1933 | Italy | 102/276 |

*Primary Examiner*—Stephen Johnson

*Attorney, Agent, or Firm*—Donald F. Mofford; Richard M. Sharkansky

[57] ABSTRACT

A time delay fuze is shown to include a fuze base having an outer surface with a circular shape and a center cavity with an inner wall having a plurality of bores disposed through the inner wall to the outer surface. The time delay fuze further includes a plurality of encoder rings disposed about the fuze base, each one of the encoder rings having an inner surface with a predetermined arrangement of lands and grooves, the inner surface of each one of the encoder rings disposed adjacent the outer surface of the fuze base and a circuit board having a plurality of switches disposed in the center cavity of the fuze base. Completing the time delay fuze are a plurality of actuating pins disposed in corresponding bores provided in the inner wall of the center cavity, each one of the actuating pins having a first and a second end with the first end adjacent and interacting with the land and grooves of the inner surface of one of the encoder rings and the second end adjacent and actuating a corresponding one of the plurality of switches. With such an arrangement, the encoder rings are easily rotated, in turn, activating the plurality of switches to set the time delay of the fuze.

14 Claims, 5 Drawing Sheets

TIME DELAY FUZE

BACKGROUND OF THE INVENTION

This invention pertains generally to fuzes for projectiles and more particularly to a fuze for an artillery or mortar projectile with an explosive or expulsion charge, the fuze capable of providing a time delay before activating the explosive or expulsion projectile.

As is known in the art, it is often necessary to delay detonation of a projectile with an explosive or expulsion charge after firing. In a changing battlefield, it is necessary to change the length of the delay quickly and easily. Known time delay fuzes include making a portion of the electronic control circuit available to the user so that a particular wire or other connecting device may be broken to set the predetermined time delay. Additionally, encoder rings have been used, wherein the encoder rings are rotated, setting a predetermined time delay for the fuze. A projectile with an explosive or expulsion charge requiring a time delay before activation could be adapted to provide quick and easy setting of the time delay by a user in a stressful environment. Thus, it is desirable to provide a fuze having a multiple of discrete timing settings which can be easily selected by the user, while minimizing the number of components in the fuze. Additionally, since the fuze is expendable, the fuze should be constructed inexpensively, yet be durable enough to withstand the influence of the dynamic forces that are exerted upon the fuze when being projected by a launcher.

SUMMARY OF THE INVENTION

With the foregoing background of this invention in mind, it is a primary object of this invention to provide a time delay fuze which is reliable, requires less parts and is easier to assemble than known fuzes.

Still another object of this invention is to provide a time delay fuze with a setter arrangement allowing increased flexibility.

The foregoing and other object of this invention are met generally by a time delay fuze including a fuze base having an outer surface with a circular shape and a center cavity with an inner wall having a plurality of bores disposed through the inner wall to the outer surface. The time delay fuze further includes a plurality of encoder rings disposed about the fuze base each one of the encoder rings having an inner surface with a predetermined arrangement of lands and grooves, the inner surface of each one of the encoder rings disposed adjacent the outer surface of the fuze base and a circuit board having a plurality of switches disposed in the center cavity of the fuze base. Completing the time delay fuze are a plurality of actuating pins disposed in corresponding bores provided in the inner wall of the center cavity, each one of the actuating pins having a first and a second end with the first end adjacent and interacting with the land and grooves of the inner surface of one of the encoder rings and the second end adjacent and actuating a corresponding one of the plurality of switches.

With such an arrangement, the encoder rings are easily rotated, in turn, activating the plurality of switches to set the time delay of the fuze.

In accordance with the still further aspect of the present invention, the time delay fuze includes a time delay circuit having a precision time count circuit responsive to the plurality of switches and fed by a clock signal, for providing a precision time count corresponding to a setting of the plurality of switches and a clock circuit for providing the clock signal. Completing the time delay circuit is a power source to provide power to the clock circuit and the precision time count circuit.

With such an arrangement, the setting of the encoder rings having a corresponding disposition of switch settings is translated to a corresponding time delay with a precision time count before the time delay fuze is activated.

BRIEF DESCRIPTION OF THE DRAWINGS

For a more complete understanding of this invention reference is no made to the following description of the accompanying drawings, wherein.

DESCRIPTION OF THE PREFERRED EMBODIMENT

Figure 1:
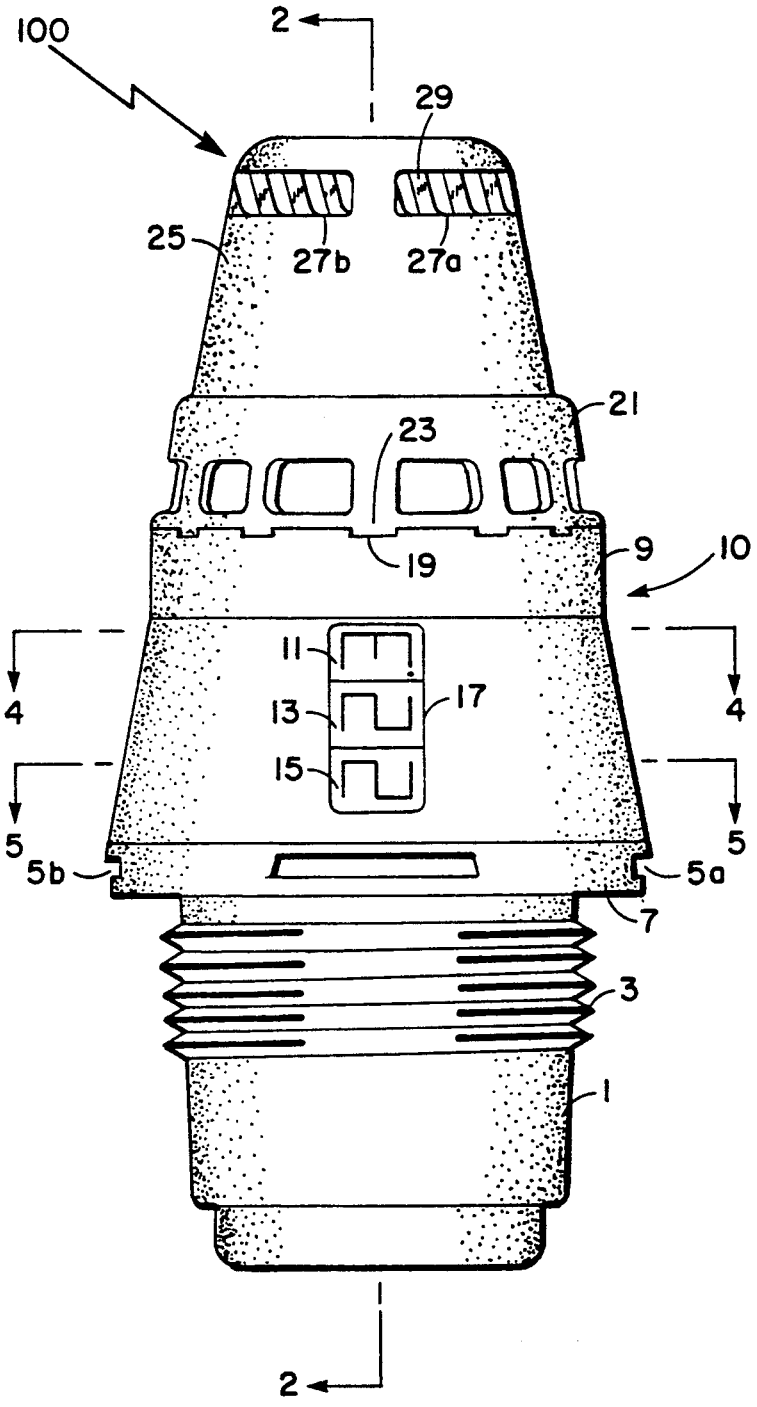
FIG. 1 is a plan view of head of a projectile incorporating a time delay fuze according to the invention.

Referring now to FIG. 1, a head 100 of a projectile (not shown) is shown with a fuze 10 according to this invention. The projectile (not shown) is either a non-spinning or spin stabilized projectile shot from a gun. A fuze base 1 with interface thread 3 is used to attach the head 100 to the projectile (not shown) by screwing the head 100 to the projectile. Wrench slots 5*a*, 5*b* are provided in a fuze shelf 7 to facilitate the screwing of head 100 to the projectile. A window ring 9 encircles a plurality of rotatable elements, here encoder ring 11, encoder ring 13 and encoder ring 15. The window ring 9 is here an opaque plastic masking digits disposed on the outer periphery of each of the encoder rings 11, 13 and 15. A transparent window 17 is provided in a portion of the window ring 9 to allow viewing of the digits on each encoder ring 11, 13 and 15 for the purpose of setting a desired time code. As shown in FIG. 1, the time code is 22.3 indicating 22.3 seconds for a time delay. A plurality of notches including notch 19, are disposed circumferentially spaced about the window ring 9 to function as a locking interface for setter ring 21. The setter ring 21, which will be described in more detail hereinafter, is used to change the time delay by moving the encoder rings 11, 13 and 15. The setter ring 21 with a plurality of tangs including tang 23, each tang corresponding with one of the plurality of notches, mates with the window ring 9 in the locked position, such that each one of the plurality of tangs engages a corresponding one of the plurality of notches. Hence, when in the locked position, the setter ring 21 cannot be rotated. The setter ring includes a plurality of flutes (not numbered) to facilitate positive gripping of the setting collar.

Completing the external configuration, an aero-fairing 25 is disposed in the fore portion of the head 100. The aero-fairing 25 has a circular air inlet port 33 (FIG.

Figure 2:
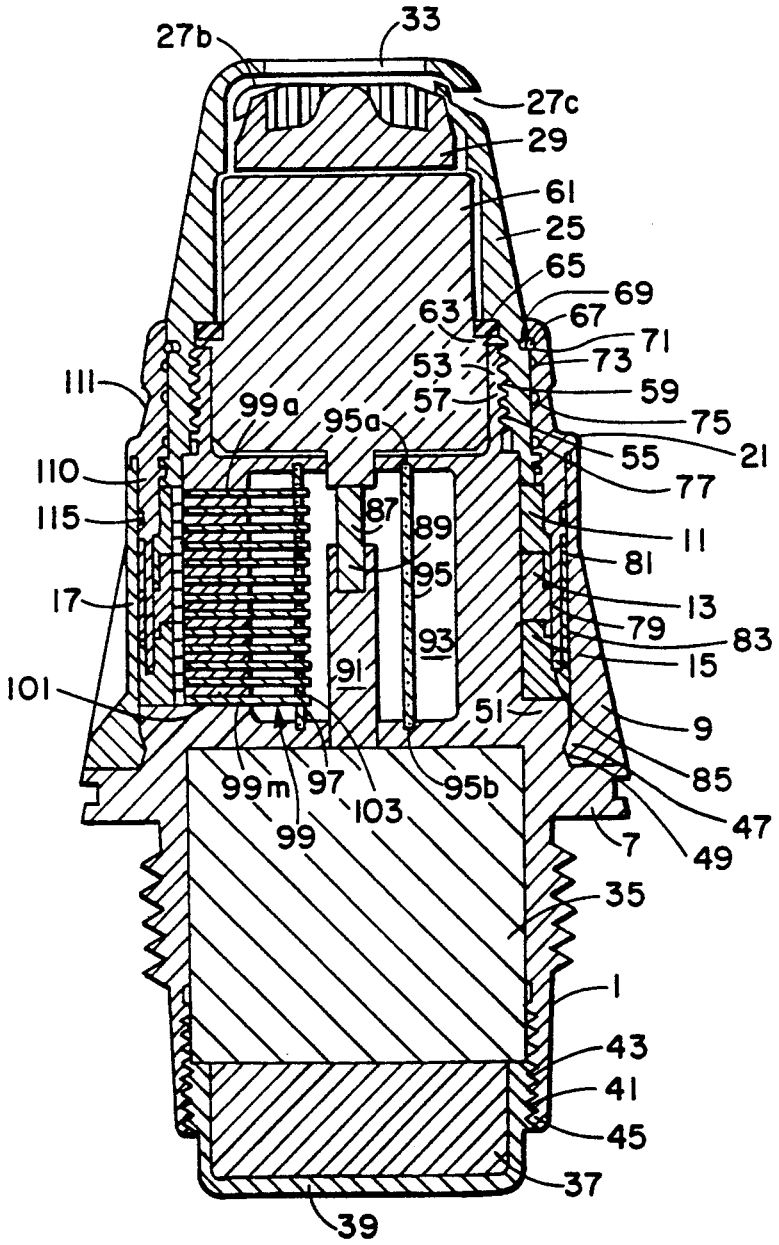
FIG. 2 is a cross-sectional view taken along the line 2—2 of FIG. 1.

2) and three equally spaced air exit ports 27*a*, 27*b* and 27*c* (FIG. 2), which allow air to drive a generator turbine wheel 29 disposed inside the aero-fairing 25 juxtaposed the air exit ports 27*a*, 27*b* and 27*c* (FIG. 2).

Referring now to FIG. 2, a cross sectional view of the head 100, the fuze base 1 is shown to have a cylindrical cavity (not numbered) wherein a safe and arm device 35 is housed. In an aft portion of the head 100, a booster or here an expulsion or booster charge 37 is housed. The safe and arm device 35 and the expulsion or booster charge 37 are secured by an expulsion or booster charge enclosure 39 having a threaded interface 41 with threads 43 to correspond with threads 45 disposed on an inner surface of the fuze base 1.

The fuze shelf 7 which is disposed at a central portion of the fuze base 1 supports the window ring 9. The window ring 9 is adjacent and encircles a portion of the fuze base 1 as well as encircling encoder rings 11, 13 and 15 and a portion of the setter ring 21. The window ring 9 is attached to the fuze base 1 by a compression fitting 47 provided at an aft portion of an internal wall of the window ring 9 which mates with a depression 49 provided circumferentially about the fuze base 1 forward of the fuze shelf 7. The transparent window 17 is disposed in the window ring 9 to allow visibility of the digits disposed on the periphery of each of the encoder rings 11, 13 and 15. Hence, a discrete timing code can be viewed at the transparent window 17. An outer truncated conical surface of the window ring 9 provides a portion of the external aerodynamic shape of the head 100.

The encoder rings 11, 13 and 15 are disposed encircling the fuze base 1 and an aft portion of the encoder ring 15 is disposed adjacent an encoder ring shelf 51 provided as part of fuze base 1. The encoder ring shelf 51 prevent the encoder ring 15 from moving in the aft direction. The encoder ring 13 encircles fuze base 1 and is disposed adjacent the encoder ring 15 with the aft portion of the encoder ring 13 adjacent the fore portion of the encoder ring 15. The encoder ring 11 encircles fuze base 1 and is disposed adjacent the encoder ring 13 with the aft portion of the encoder ring 11 adjacent the fore portion of the encoder ring 13.

The aero-fairing 25 is attached to a fore portion 53 of the fuze base 1 by a common threaded interface 55 between threads 57 provided on the fore portion 53 of the fuze base 1 and threads 59 provided on an internal cylindrical surface of the aero-fairing 25. The aero-fairing 25 is shown to have a cylindrical cavity (not numbered) wherein the generator turbine wheel 29 and a generator 61 is housed. The generator 61 includes a flange 63 which sits on the fore portion 53 of the fuze base 1. A circular elastomeric ring 65 fits adjacent the flange 63. Upon attaching the aero-fairing 25 to the fuze base 1 by screwing together threads 57 and threads 59 at the common threaded interface 55, the circular elastomeric ring 65 is compressed and the generator 61 is locked into an assembled position. With the aero-fairing 25 fully secured to the fuze base 1, the fore portion of the encoder ring 11 is adjacent the aft portion of the aero-fairing 25 which limits the encoder rings 11, 13 and 15 from moving in the fore direction but allows the encoder rings 11, 13 and 15 to rotate freely.

The setter ring 21 is disposed encircling a portion of the aero-fairing 25 and when in a locked position the plurality of tangs including tang 23 (FIG. 1) of the setter ring 21 are engaged with the corresponding plurality of notches, including notch 19 (FIG. 1), of the window ring 9. A spring ring 67 is disposed in a groove 69 disposed in the outer surface of the aero-fairing 25 as shown to engage a corresponding groove 71 disposed on the inner surface of the setter ring 21 such that the setter ring 21 is locked in position. A plurality of registration setting rods 79, here numbering ten, are disposed at the aft portion of the setter ring 21 as shown, each one of the setting rods 79 having a certain length to engage a corresponding hole provided by bores 81, 83, and 85 of encoder rings 11, 13, and 15 respectively. Accordingly, when the setter ring 21 is in the locked position, registration setting rods 79 are capturing bores 81, 83 and 85 of encoder rings 11, 13 and 15, respectfully, preventing the encoder rings 11, 13 and 15 from rotating.

To change the timing code, as viewed through the transparent window 17, the setter ring 21 is raised to a registration position in which spring ring 67 is engaged by groove 73 so that the plurality of tangs including tang 23 (FIG. 1), are no longer engaged with the plurality of notches including notch 19 (FIG. 1). In such a position, the setter ring 21 can be freely rotated which, in turn, rotates the encoder rings 11, 13 and 15. Looking through the transparent window 17 and viewing the tens digits provided on the outer periphery of the encoder ring 15, the setter ring 21 is rotated until an appropriate digit is viewed in the transparent window 17. The setter ring 21 is again raised to a registration position in which spring ring 67 is engaged by groove 75 of the setter ring 21 s that the registration setting rods 79 are withdrawn from the bores 85 of encoder ring 15. Rotating the setter ring 21 will now rotate encoder rings 11 and 13. Viewing the digits on the periphery of encoder ring 13 through the transparent window 17, the setter ring 21 is rotated until an appropriate ones digit is viewed in the transparent window 17. Again the setter ring 21 is raised to a registration position in which spring ring 67 is engaged by groove 77 of the setter ring 21 so that the registration setting rods 79 are withdrawn from the bores 83 of encoder ring 13. Viewing the digits on the periphery of encoder ring 11 through transparent window 17, the setter ring 21 is rotated until an appropriate tenths digit is viewed in the transparent window 17. In the embodiment shown, bores 81 and 83 are equally spaced with a quantity of ten bores in each respective encoder ring, thus providing each encoder ring a capability of being locked in one of ten positions corresponding to one of ten digits provided on the periphery of each one of the encoder rings 11 and 13. Bores 85 are equally spaced with a quantity of twenty bores in the encoder ring 15 periphery the encoder ring 15 the capability of being locked in one of twenty positions corresponding to one of twenty digits provided on the periphery of the encoder ring 15. After all three digit positions have been set, the setter ring 21 is closed and locked with the spring ring 67 engaged with groove 71 of the setter ring 21, thus securing the encoder rings 11, 13 and 15 with an appropriate timing code viewed in the transparent window 17. The setter ring 21 is manually operable through contact with a series of uniform spaced peripheral depressions 11 disposed in the external periphery of the setter ring 21 to facilitate longitudinal and rotational translation of the setter ring 21 for visually setting the desired timing code. A first elastomeric seal 113 is employed as shown between the aero-fairing 25 and the internal surface of the setter ring 21 and a second elastomeric seal 115 is employed as shown between the external surface of the setter ring 21 and the internal surface of the window ring 9 to seal and protect inner components of the head 100 from the external environment.

As described briefly hereinabove, the aero-fairing 25 includes a cylindrical cavity (not numbered) wherein the generator turbine wheel 29 and the generator 61 is housed. The aero-fairing 25 includes the air intake port 33 which directs ram air when the head 100 is in motion at the turbine wheel 29 causing the turbine wheel 29 to rotate. The air is then exhausted through the air exit ports 27*a* (FIG. 1), 27*b* and 27*c* which are disposed peripherally about the aero-fairing 25. The generator 61 provides enough electric power to feed an electronic circuit (not shown) as described further hereinafter. The generator 61 includes a driven output shaft 87 which interacts through a spline connection 89 with an input shaft 91 of the safe and arm device 35. Such an interaction provides a mechanical in-flight arming of the head 100 allowing the head 100 to detonate the artillery projectile. The outer surface of the aero-fairing 25 is shaped to provide a portion of the external aerodynamic shape of the head 100.

In a central portion of the head 100, a central cavity 93 is provided wherein the driven output shaft 87 and the input shaft 91 of the safe and arm device 35 occupies the center thereof. An electronic module including circuit board 95 and circuit board 97 is disposed, as shown, in the central cavity 93. The circuit board 95 is held in place by a pair of slots 95*a* and 95*b* provided in the fore and aft wall of the central cavity 93. Similarly, the circuit board 97 is also held in place by a pair of slots (not numbered) provided in the fore and aft wall of the central cavity. A plurality of actuating pins 99 are disposed in a plurality of corresponding bores 101 provided in a portion of the wall of the central cavity 93 adjacent to the transparent window 17. As described hereinabove, the encoder rings 11, 13, and 15 are rotated about fuze base 1 to select an appropriate timing code as required. A plurality of lands and grooves (not shown) are provided on the inner surface of each of the encoder rings 11, 13, and 15 which interact with the actuating pins 99. Each one of the actuating pins 99, depending upon whether a land or a groove is interacting on that one pin, causes one of a plurality of corresponding contacts 103 disposed on the circuit board 97, either to make or break contact with a ground plane (not shown) disposed on the circuit board 97. Thus, the actuating pins 99 activate the contacts 103 in a predetermined manner to correspond with the digits viewed through the transparent window 17. In the embodiment shown, a binary coded decimal (BCD) code is used to implement the necessary coding. For the timing code displayed in FIG. 1, 22.3, the encoder ring 15 provides a BCD code of 2, the encoder ring 13 provides a BCD of 2 and the encoder ring 11 provides a BCD code of 3. Whereas each one of the encoder rings 11 and 13 activate four actuating pins to provide the binary coded decimal code, it should be appreciated the two foremost actuating pins 99*a* and 99*b* of the four actuating pins acted upon by encoder ring 11 are actuated to open the corresponding contacts on the circuit board 97 to provide a BCD code of three to the electronic module (not numbered). The second foremost actuating pin 99*f* of the four actuating pins acted upon by encoder ring 13 is actuated to open the corresponding contact on the circuit board 97 to provide a BCD code of 2 to the electronic module (not numbered). In the present embodiment, encoder ring 15 actuates five actuating pins with the four foremost actuating pins 99*i*, 99*j*, 99*k* and 99*l* providing the BCD code for the tens digit and the fifth actuating pin 99*m* providing the code for zero or one of the hundreds digits. The second foremost actuating pin 99*j* of the four actuating pins acted upon by the encoder ring 15 to provide the tens digit is actuated to open the corresponding contact on the circuit board 97 to provide a BCD code of 2 to the electronic module (not numbered). Whereas the hundreds digit is zero, the fifth actuating pin 99*m* is not actuated by the encoder ring 15. With the latter in mind, it should now be appreciated by appropriately entering a timing code in window 17 as described hereinbefore, a corresponding binary coded decimal (BCD) code is implemented by the contacts on circuit board 97. As described, the fuze 10 is capable of providing a precision time count from 0.1 seconds to 199.9 seconds by appropriately setting the encoder rings 11, 13, and 15.

Figure 3A:
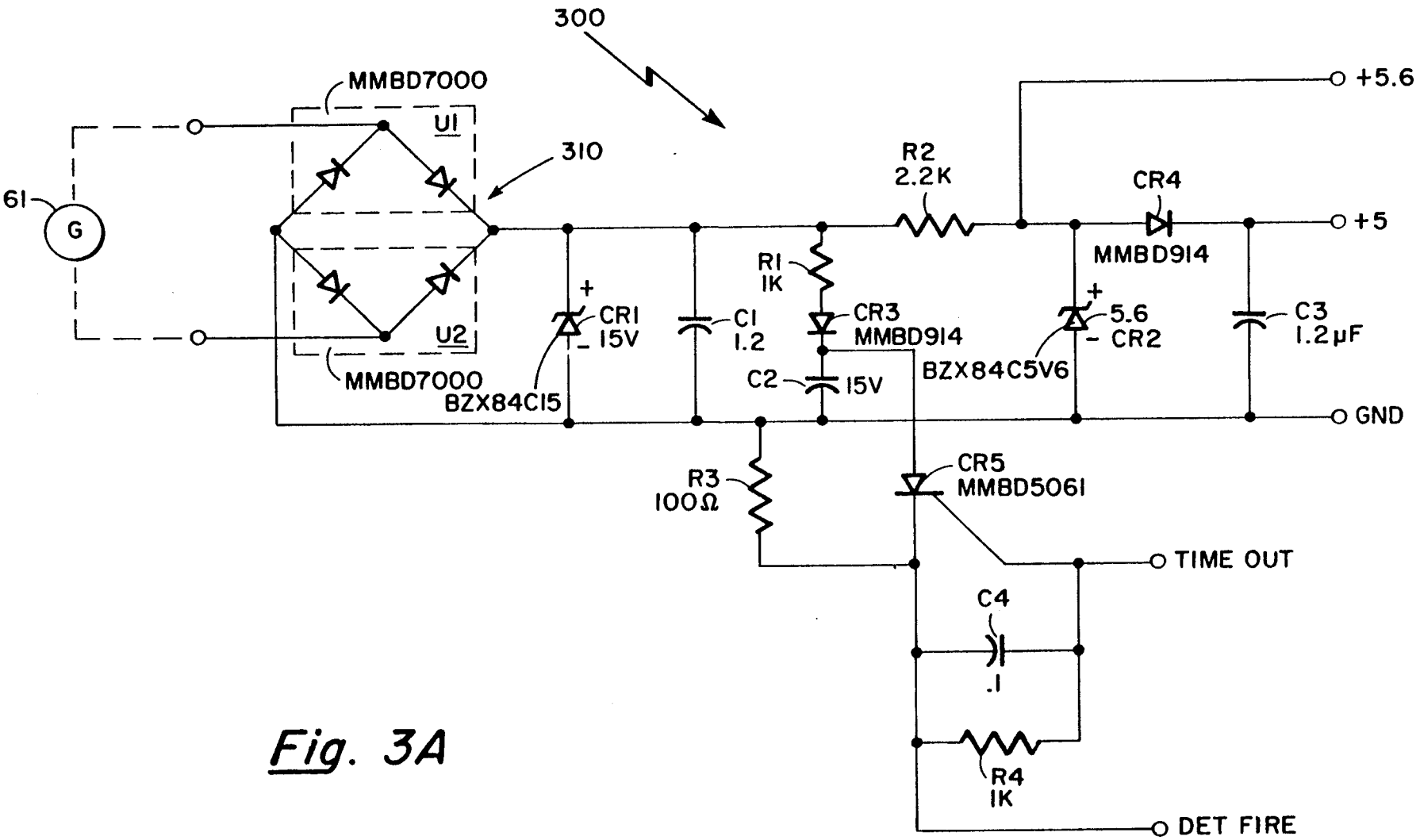
FIGS. 3A and 3B together are a schematic diagram of a time delay circuit utilized in the fuze.
Figure 3B:
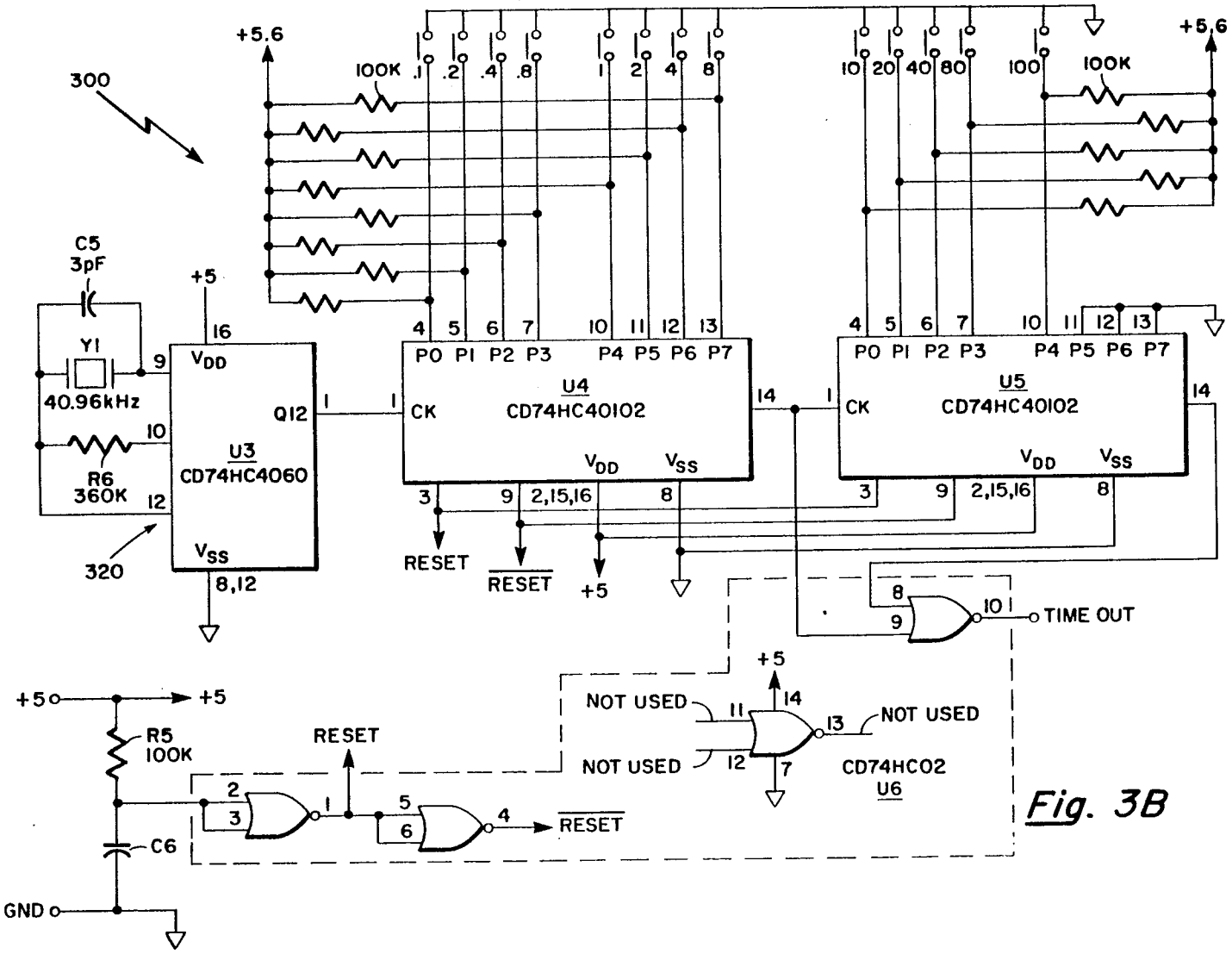

Referring now to FIGS. 3*a* and 3*b*, a schematic diagram of the electronic module implemented on circuit board 95 and circuit board 97 to provide the time delay circuit 300 is shown to be fed by a power source provided by the generator 61. The details of the electrical schematic following herein should not be construed as the sole electric device capable of performing the required power regulation and time count functions, rather a specific solution. A full wave rectifier 310 is provided by a pair of integrated circuits U1, U2. Here the integrated circuit is a MMBD7000, manufactured by Motorola, Inc. of Phoenix, Ariz. The output of the full wave rectifier is shunted by a Zener diode, CR1, here a BZX84C15, manufactured by Motorola, Inc. which, acting as a voltage regulator, provides a 15 volt signal source with a 15 volt signal across the terminal thereof. An RC network provided by a 1.2 microfarad capacitor C1 in shunt and a 2.2K ohm resistor R2 in series provides further filtering of the 15 volt signal. A second Zener diode CR2 is shunted between the 2.2K ohm resistor R2 and ground to provide a 5.6 volt signal across the terminals of the second Zener diode CR2. The second Zener diode CR2, which is acting as a voltage regulator, is here a BZX84C5V6 manufactured by Motorola, Inc. and provides a 5.6 volt voltage source to the time delay circuit 300. A diode CR4, here a MMBD914, manufactured by Motorola, Inc., is disposed in series as shown to provide an appropriate voltage drop. With a 1.2 microfarad capacitor C3 disposed in shunt as shown to provide further filtering, a 5 volt voltage source with a 5 volt signal is then provided to the time delay circuit 300.

A pair of 8 bit counters $U_4$, $U_5$, here a pair of CD74HC40102 integrated circuits manufactured by RCA, Solid State Division of Somerville, N.J. are used to decode the switch settings which were described hereinbefore. Thus, each one of the contacts are connected to a corresponding one of the inputs of the pair of 8 bit counters $U_4$, $U_5$, each corresponding one of the inputs also connected to the 5.6 volt voltage source through a 100 KΩ resistor (not numbered) as shown. The extra input pins, pins 11, 12 and 13 of the second 8 bit counter $U_5$, which are not used for decoding, are connected to ground.

A clock circuit 320, here providing a clock signal with a frequency of 10 HZ, is provided by a divider $U_3$, here a CD74HC4060 integrated circuit manufactured by Texas Instrument, Inc. of Dallas, Tex., connected as shown with a crystal $Y_1$ with a frequency of 40.96 KHz. A 3 picofarad capacitor $C_5$ and a 360 KΩ resistor R6 are also connected as shown. The clock signal provided at the output of the divider, $U_3$ is fed to a clock input port of the first 8 bit counter $U_4$.

A CD74HC02 integrated circuit $U_6$ manufactured by Texas Instrument, Inc. of Dallas, Tex. having a plurality of NOR gates disposed therein provides a pair of NOR gates which are connected as shown with a 100 KΩ resistor R5 and a 0.1 uF capacitor $C_6$ to provide a reset signal and a not reset signal to the time delay circuit 300. The reset signal and the not reset signal are connected as shown to the pair of 8 bit counters $U_4$, $U_5$. A third NOR gate of the CD74HC02 integrated circuit U6 is connected as shown with each input connected to an output from a corresponding one of the pair of 8 bit counters $U_4$, $U_5$ with the output of the third NOR gate providing a time out signal to the time delay circuit 300.

A 1 KΩ resistor $R_1$, a diode $CR_3$, here an MMBD914, and a capacitor $C_2$ are disposed in series as shown between ground and the 15 volt signal source. The capacitor $C_2$ during normal operation charges up to a 15 volt potential. In the event the generator 61 stops producing power, for example during maximum projectile amplitude, the capacitor $C_2$ will discharge providing an interim power supply for the time delay circuit 300.

A semiconductor controlled rectifier (SCR) $CR_5$, here a MMBS5061 manufactured by Motorola, Inc. is disposed with a cathode terminal connected to a junction between the diode $CR_3$ and the capacitor $C_2$ and with an anode terminal connected in series to a 100 Ω resistor $R_3$ which in turn is connected to ground as shown.

The time out signal is fed to a trigger input of the SCR $CR_5$ which, when conducting, provides a detonation fire signal as shown to the explosive, which detonates the explosive. A 0.1 MF detonator capacitor $C_4$ is connected in shunt with a 1 KΩ resistor $R_4$ between the trigger input and the anode of the SCR $CR_5$ as shown.

It should now be appreciated, upon firing of the projectile and with the timing code set for 22.3 seconds, the generator 61 will provide an input signal to the full wave rectifier which will provide the 15 volt voltage source, the 5.6 volt voltage source and the 5 volt voltage source, which then feed appropriate voltages to the time delay circuit 300. With the switches closed corresponding to 22.3 seconds, the time delay circuit 300 counts up to 22.3 seconds and provides the time out signal to the SCR $CR_5$ which in turn provides the detonation fire signal to the explosive causing the explosive or expulsion charge activate.

Figure 4:
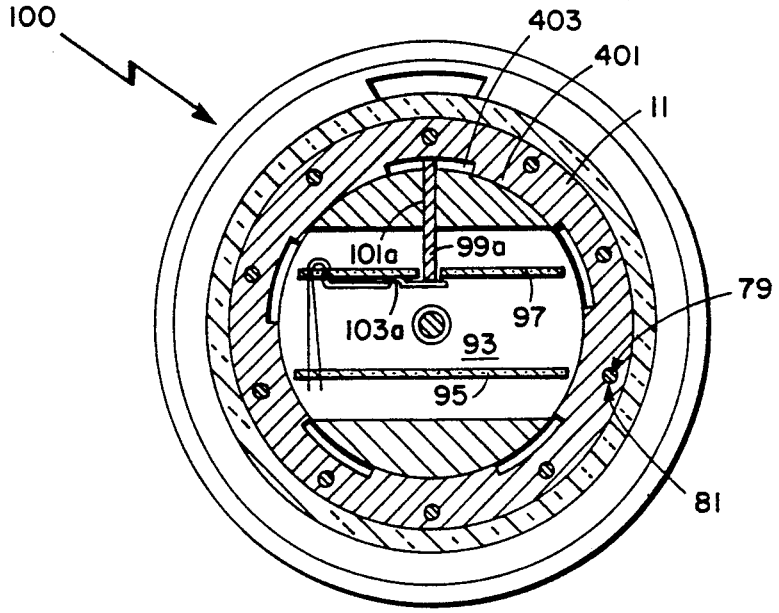
FIG. 4 is a cross-sectional view take along the line 4—4 of FIG. 1 showing an encoder ring cooperating with an actuating pin, which in turn, actuates a switch used in the fuze.

Referring now to FIG. 4, a cross-sectional view of the head 100 taken along the line 4—4 of FIG. 1, the actuating pin 99*a* is shown disposed in bore 101*a* and extending through a portion of the wall of the central cavity 93. A first end of the actuating pin 99*a* is shown adjacent a groove 403 disposed on the inner surface of the encoder ring 11. A second opposing end of the actuating pin 99*a* is shown adjacent a contract 103*a* which makes or breaks contact with a ground plane (not shown) providing a switch to ground. In other words, when a land, such as land 401, is adjacent the first end of actuating pin 99*a*, the contact 103*a* breaks contact with the ground plane (not shown) providing an open circuit to the corresponding input of the 8 bit counter $U_4$ (FIG. 3*b*) of the time delay circuit 300 (FIG. 3*b*). When a groove such as groove 403, is adjacent the first end of actuating pin 99*a*, the contact 103*a* makes contact with the ground plane (not shown) providing a closed circuit to the corresponding input of the 8 bit counter $U_4$ (FIG. 4*b*) of the time delay circuit 300 (FIG. 3*b*).

It should be appreciated contact 103*a* corresponds to the least significant bit of the BCD code used to implement the tenths digit. Whereas the encoder ring 11 is configured to set the tenths digit from zero to nine, the inner periphery surface of the encoder ring 11 is divided into ten segments wherein there are ten lands and groves, five lands and grooves alternating between a land segment and a groove segment on the inner periphery surface of the encoder ring 11 about actuating pin 99*a* to set the least significant bit of the BCD code for tenths digit. Referring now also to FIG. 2, it should be appreciated there are five lands and grooves associated with actuating pin 99*b*, here two lands and three grooves. The inner periphery surface of encoder ring 11 is divided into ten segments with each land being two segments and each groove being two segments on the inner periphery surface of the encoder ring 11 about actuating pin 99*b* to set the next to least significant bit of the BCD code for the tenths digit. Furthermore, the inner periphery surface of encoder ring 11 about actuating pin 99*c* includes a land of six segments and a groove of four segments, of the total ten segments to set the next to the most significant bit of the BCD code of the tenths digit. Finally, the inner periphery surface about actuating pin 99*d* includes a land of eight segments and a groove of two segments of the total ten segments to set the most significant bit of the BCD code of the tenth digit. With such an arrangement, angular rotation of the encoder ring 11 changes the land and groove disposition about the respective actuating pins 99*a*, 99*b*, 99*c* and 99*d* and implementing a binary coded decimal (BCD) representation, corresponding contacts are opened or closed to set the switches to represent the tenths digit for the time delay circuit 300.

In the present example, the tenths digit is set for 3 and the BCD representation of 3 is 0011. Accordingly, the least significant bit is set by actuating pin 99*a* wherein the first end of actuating pin 99*a* is adjacent a groove 403 so that contact 103*a* is closed. The next to the least significant bit is set by actuating pin 99*b* wherein a first end of the actuating pin 99*b* is adjacent a groove (not shown) so that a corresponding contact is closed. The next to the most significant bit is set by actuating pin 99*c* wherein a first end of the actuating pin 99*c* is adjacent a land (not shown) so that a corresponding contact is open. The most significant bit is set by actuating pin 99*d* wherein a first end of the actuating pin 99*d* is adjacent a land (not shown) so that a corresponding contact is open. With such an arrangement, the BCD representation of 3 is implemented.

The encoder ring 13 is configured similar to the encoder ring 11, such that the disposition of the various lands and grooves on the inner periphery surface of the encoder ring 13 is similar to the inner periphery surface of the encoder ring 11. In the present example, the ones digit is set for 2 and the BCD representation of 2 is 0010. Accordingly, the least significant bit is set by actuating pin 99*e* wherein the first end of actuating pin 99*e* is adjacent a land (not shown) so that the corresponding contact is open. The next to the least significant bit is set by actuating pin 99*f* wherein a first end of the actuating pin 99*f* is adjacent a groove (not shown) so that a corresponding contact is closed. The next to the most significant bit is set by actuating pin 99*g* wherein a first end of the actuating pin 99*g* is adjacent a land (not shown) so that a corresponding contact is open. The most significant bit is set by actuating pin 99*h* wherein a first end of the actuating pin 99*h* is adjacent a land (not shown) so that a corresponding contact is open. With such an arrangement, the BCD representation of 2 is implemented.

Figure 5:
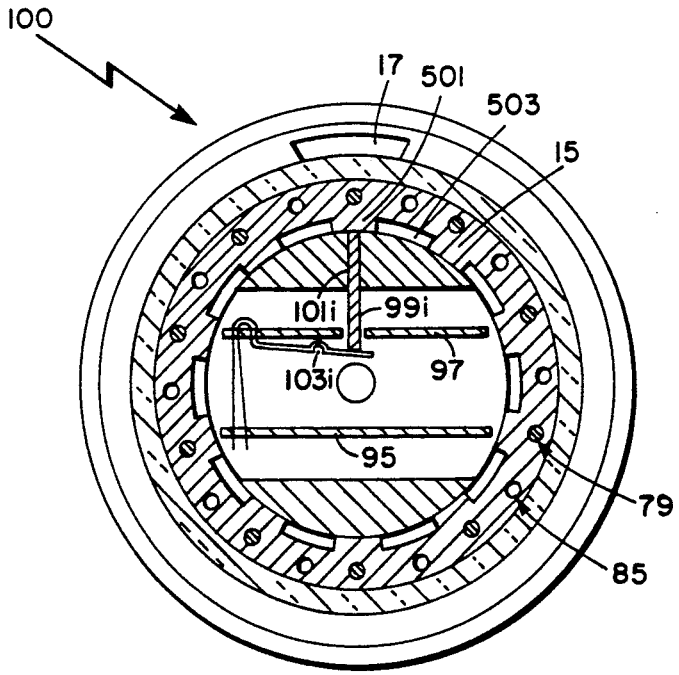
FIG. 5 is a cross-sectional view taken along the line 5—5 of FIG. 1 showing a different encoder ring cooperating with an actuating pin.

Referring now to FIG. 5, a cross-sectional view of the head 100 taken along the line 5—5 of FIG. 1, the actuating pin 99*i* is shown disposed in bore 101*i* and extending through a portion of the wall of the central cavity 93. A first end of the actuating pin 99*i* is shown adjacent a land 501 disposed on the inner surface of the encoder ring 15. A second opposing end of the actuating pin 99*i* is shown adjacent a contact 103*i* which is open from the ground plane (not shown) providing an open circuit to the corresponding input of the 8 bit counter $U_5$ (FIG. 3*b*) of the time delay circuit 300. The contact 103*i* corresponds to the least significant bit of the BCD code used to implement the tens digit. Here, the encoder ring 15 is configured to set the tens digit from zero to nine and the hundreds digit from zero to one, so that there are twenty lands and grooves, ten lands and ten grooves alternating between land and groove, on the inner periphery surface of the encoder ring 15 to set the least significant bit of the BCD code for the tens digit. The inner periphery surface of encoder ring 15 is divided into twenty segments with each land being one segment and each groove being one segment on the inner periphery surface of the encoder ring 15 about actuating pin 99*i*. With such an arrangement, the tens digit can be set from zero to nine when the hundred digit is zero and the tens digit can be set from zero to nine when the hundreds digit is one.

Referring now to FIGS. 2 and 5, in the present example, the tens digit is set for 2 with a BCD representation of 0010 and the hundreds digit is set for zero. Accordingly, the least significant bit is set by actuating pin 99*i* wherein the first end of actuating pin 99*i* is adjacent a land 501 so that the corresponding contact 103*i* is open. The next to the least significant bit is set by actuating pin 99*j* wherein a first end of the actuating pin 99*j* is adjacent a groove (not shown) so that a corresponding contact is closed. The next to the most significant bit is set by actuating pin 99*h* wherein a first end of the actuating pin 99*h* is adjacent a land (not shown) so that a corresponding contact is open. The most significant bit is set by actuating pin 99*l* wherein a first end of the actuating pin 99*l* is adjacent a land (not shown) so that a corresponding contact is open. With such an arrangement, the BCD representation of 2 is implemented. To set the hundreds digit, which here is limited to either zero or one, a single bit is set by actuating pin 99*m* and in the present example a first end of the actuating pin 99*m* is adjacent a land (not shown) so that a corresponding contact is open setting the hundreds digit to zero.

It should be appreciated the corresponding disposition of lands and grooves in the inner periphery surface of encoder ring 15 for the ten digit when the hundreds digit is zero is the same as the disposition of lands and grooves in the inner periphery surface of encoder ring 15 for the tens digit when the hundreds digit is one.

Referring now to FIGS. 2, 4 and 5, when changing the timing code, as viewed through the transparent window 17, the setter ring 21 is raised to a registration portion in which spring ring 67 is engaged by groove 73 so that the setter ring 21 can freely rotate to rotate, interacting through registration setting rods 79, the encoder rings 11, 13 and 15. The encoder ring 15 is rotated to one of twenty positions corresponding to indicia labeled 0, 1, 2 . . . 18 and 19 on the outer periphery surface of the encoder ring 15 and a corresponding segment on the inner periphery surface of the encoder ring 15 to implement a corresponding BCD code.

The actuating pins 99*i*, 99*j*, 99*k*, 99*l* and 99*m* are set accordingly by the corresponding lands and grooves on the inner periphery surface of the encoder ring 15 which in turn open or close the corresponding contacts. In the disclosed embodiment, there are ten registration setting rods 79 which engage ten of the twenty bores 85 provided in the encoder ring 15 to hold the encoder ring 15 in position.

After setting the encoder ring 15, here to 2, the setter ring 21 is raised to a registration position in which spring ring 67 is engaged by groove 75. The encoder ring 13 is rotated to one of ten positions corresponding to indicia labeled 0, 1, 2 . . . 8 and 9 on the outer periphery surface of the encoder ring 13 to implement a corresponding BCD code. The actuating pins 99*e*, 99*f*, 99*g* and 99*h* are set accordingly which in turn open or close the corresponding contacts. After setting the encoder ring 13, here to 2, the setter ring 21 is raised to a registration position in which spring ring 67 is engaged by groove 77. The encoder ring 11 is rotated to one of ten positions corresponding to indicia labeled 0, 1, 2 . . . 8 and 9 on the outer periphery surface of the encoder ring 11 to implement a corresponding BCD code. The actuating pins 99*a*, 99*b*, 99*c* and 99*d* are set accordingly which in turn open or close the corresponding contacts. The encoder ring 11, like the encoder ring 13, has ten bores 91 disposed therein which are engaged by the ten registration rods 79.

After setting the encoder ring 11, here to 3, the setter ring 21 is lowered to the registration position in which spring ring 67 is engaged by groove 69, thus locking the setter ring 21, as well as encoder rings 11, 13 and 15, into position. The time delay circuit 300 (FIGS. 3*a* and 3*b*) disposed on circuit boards 95 and 97 is now set to have a time delay of 22.3 seconds. With such an arrangement, the fuze 10 can be set from 00.0 to 199.9 seconds.

Having described this invention, it will not be apparent to one of skill in the art that various elements of the fuze may be changed without affecting this invention. For example, the encoder ring 15 could be configured as encoder rings 11 and 13 providing a time delay range of 00.0 to 99.9 seconds. It is felt, therefore, that this invention should not be restricted to its disclosed embodiment, but rather should be limited only by the spirit and scope of the appended claims.

What is claimed is:

1. A fuze for an artillery projectile comprising:

(a) a fuze base having an outer surface with a circular shape and a center cavity with an inner wall having a plurality of bores disposed through the inner wall to the outer surface;

(b) a plurality of encoder rings disposed about the fuze base, each one of the encoder rings having an inner surface with a predetermined arrangement of lands and grooves, the inner surface of each one of the encoder rings disposed adjacent the outer surface of the fuze base, each one of the encoder rings also having a plurality of bores;

(c) a circuit board having a plurality of switches, the circuit board disposed in the center cavity of the fuze base;

(d) a plurality of actuating pins disposed in the bores of the inner wall of the center cavity, each one of the actuating pins having a first and a second end with the first end adjacent and interacting with the land and grooves of the inner surface of one of the encoder rings and the second end adjacent and actuating a corresponding one of the plurality of switches; and (e) a setter ring having a plurality of registration rods disposed to capture a corresponding one of the plurality of bores.

2. The fuze as recited in claim 1 further comprising:

(a) a predetermined code having a plurality of code elements recorded on the periphery of each one of the plurality of encoder rings; and (b) a window ring having a transparent window and disposed so that the plurality of code elements are viewed in the transparent window.

3. The fuze as recited in claim 1 further comprising a time delay circuit comprising:

(a) means, responsive to the plurality of switches having an opened and a closed condition and fed by a clock signal, for providing a precision time count corresponding to the opened and closed condition of the plurality of switches;

(b) means for providing the clock signal; and (c) a power source to provide power to the means for providing the clock signal and means for providing a precision time count.

4. The fuze as recited in claim 1 wherein the setter ring comprises an outer surface with a plurality of flutes to facilitate positive gripping of the setting ring.

5. A fuze for an explosive projectile comprising:

(a) a fuze base having an outer surface with a circular shape and a center cavity with an inner wall having a plurality of bores disposed through the inner wall to the outer surface;

(b) a rotatable element having an inner surface, an aft surface and a fore surface, the inner surface of the rotatable element having a predetermined arrangement of lands and grooves, the rotatable element further having a plurality of bores extending into the fore surface to the aft surface thereof;

(c) a plurality of actuating pins having an end and disposed in the bores of the inner wall of the fuze base, the end of each one of the actuating pins being adjacent the inner of the fuze base, the end of each one of the actuating pins being adjacent the inner surface of the rotatable element and interacting with the lands and grooves; and (d) a setter ring having an inner surface and an aft surface with a registration pin disposed on the aft surface of the setter ring and dimensioned to fit in one of the bores extending into the fore surface to the aft surface of the rotatable element, the inner surface of the setter ring encircling a portion of the fuze base and the aft surface of the setter ring disposed adjacent the fore surface of the rotatable element.

6. The fuze as recited in claim 5 wherein the rotatable element also has an outer surface and the rotatable element further comprises digits exposed on the outer surface.

7. The fuze as recited in claim 6 further comprising a window ring having a transparent window, the transparent window disposed juxtaposed the digits disposed on the outer surface of the rotatable element.

8. The fuze a recited in claim 7 further comprising a plurality of switches, each one of the plurality of switches disposed in the center cavity of the fuze base and disposed juxtaposed a corresponding one of the plurality of actuating pins.

9. The fuze as recited in claim 8 further comprising a time delay circuit comprising:

(a) means, responsive to the plurality of switches having an opened and a closed condition and fed by a clock signal, for providing a precision time count corresponding to the opened and closed condition of the plurality of switches;

(b) means for providing the clock signal; and (c) a power source to provide power to the means for providing the clock signal and means for providing a precision time count.

10. A fuze for an artillery projectile comprising:

(a) a fuze base having an outer surface with a circular shape, a fuze base shelf disposed peripherally about the outer surface of the fuze base, an encoder ring shelf disposed peripherally about the outer surface of the fuze base and fore of the fuze base shelf;

(b) a plurality of rotatable elements, each element having an inner surface, an outer surface, an aft surface and a fore surface, the inner surface of the rotatable element having a predetermined arrangement of lands and grooves and the outer surface having digits disposed thereon, the plurality of rotatable elements arranged adjacent to one another such that the fore surface of one of the rotatable elements is disposed adjacent the aft surface of an adjacent one of the rotatable elements, each one of the rotatable elements further having a plurality of bores extending into the fore surface and all but one of the rotatable elements having the plurality of bores extending through the rotatable element to the aft surface thereof, the aft surface of that one of the rotatable elements not having the bore extending to the aft surface thereof being adjacent the encoder ring shelf of the fuze base;

(c) a window ring having an inner surface, an aft surface and a fore surface, the inner surface of the window ring disposed adjacent the outer surfaces of the plurality of rotatable elements and the aft surface adjacent the fuze base shelf of the fuze base, the window ring further having a transparent window that provides visibility of one of the digits on each one of the rotatable elements;

(d) an aero-fairing having an inner surface, an outer surface and an aft surface, a portion of the inner surface of the aero-fairing disposed adjacent the fuze base and the aft surface disposed adjacent the fore surface of one of the rotatable elements; and (e) a setter ring having an inner surface and an aft surface with a registration pin disposed on the aft surface of the setter ring and dimensioned to fit into one of the bores extending into the fore surface of the rotatable elements such that one of the bores of each one of the rotatable elements is captured by the registration pin of the setter ring.

11. The fuze as recited in claim 10 wherein the fuze base further comprises a center cavity with an inner wall having a plurality of bores disposed through the inner wall to the outer surface, the fuze further comprising a plurality of actuating pins disposed in the bores of the inner wall.

12. The fuze as recited in claim 11 further comprising a plurality of switches, each switch disposed adjacent a corresponding one of the plurality of actuating pins.

13. The fuze as recited in claim 12 further comprising a time delay circuit comprising:

(a) means, responsive to the plurality of switches having an opened and a closed condition and fed by a clock signal, for providing a precision time count corresponding to the opened and closed condition of the plurality of switches;

(b) means for providing the clock signal; and (c) a power source to provide power to the means for providing the clock signal and means for providing a precision time count.

14. The time delay circuit as recited in claim 13 further comprising means for providing an alternative power source to the time delay circuit when the power source is interrupted from providing power.

* * * * *